US008665162B2

(12) United States Patent
Koga

(10) Patent No.: US 8,665,162 B2
(45) Date of Patent: Mar. 4, 2014

(54) ANTENNA WITH LOOP FORM RADIATOR FOR MOBILE TERMINALS

(75) Inventor: Yohei Koga, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 181 days.

(21) Appl. No.: 13/234,607

(22) Filed: Sep. 16, 2011

(65) Prior Publication Data

US 2012/0146864 A1 Jun. 14, 2012

(30) Foreign Application Priority Data

Dec. 13, 2010 (JP) ..... 2010-276736

(51) Int. Cl.
*H01Q 1/24* (2006.01)

(52) U.S. Cl.
USPC ..... 343/702; 343/741

(58) Field of Classification Search
USPC ..... 343/702, 700 MS, 846, 741, 748
See application file for complete search history.

(56) References Cited

U.S. PATENT DOCUMENTS

| | | | | |
|---|---|---|---|---|
| 8,339,328 | B2 * | 12/2012 | Narasimhan et al. | 343/876 |
| 8,373,603 | B2 * | 2/2013 | Montgomery et al. | 343/702 |
| 8,421,702 | B2 * | 4/2013 | Desclos et al. | 343/795 |
| 2002/0180650 | A1 * | 12/2002 | Pankinaho et al. | 343/702 |
| 2007/0035458 | A1 | 2/2007 | Ohba | |
| 2007/0229372 | A1 * | 10/2007 | Desclos et al. | 343/702 |
| 2009/0251383 | A1 | 10/2009 | Tani et al. | |

FOREIGN PATENT DOCUMENTS

| | | |
|---|---|---|
| CN | 101427421 | 5/2009 |
| EP | 2 133 955 | 12/2009 |
| JP | 2001-326514 | 11/2001 |
| JP | 2006-279530 | 10/2006 |
| WO | WO 2008/046193 | 4/2008 |

OTHER PUBLICATIONS

Patent Abstracts of Japan, Publication No. 2006-279530, Published Oct. 12, 2006.
Patent Abstracts of Japan, Publication No. 2001-326514, Published Nov. 22, 2001.
European Search Report in Application No. 11184213.4 dated Mar. 14, 2012.
Espacenet English Abstract of Chinese Application No. 101427421 published May 6, 2009.
Chinese Patent Office Action dated Dec. 3, 2013 in Chinese Patent Application No. 201110306450.X.

* cited by examiner

*Primary Examiner* — Hoanganh Le
(74) *Attorney, Agent, or Firm* — Staas & Halsey LLP

(57) ABSTRACT

A radiation section of an antenna includes a first connection portion and a second connection portion, and is in a loop form having a plate shape. A switch unit couples the second connection portion to the first connection portion e.g. according to a signal input from the outside. Further, the switch unit couples the second connection portion e.g. to ground formed on a reverse side of a substrate according to a signal input from the outside.

14 Claims, 22 Drawing Sheets

ANTENNA WITH LOOP FORM RADIATOR FOR MOBILE TERMINALS

CROSS-REFERENCE TO RELATED APPLICATION

This application is based upon and claims the benefit of priority of the prior Japanese Patent Application No. 2010-276736, filed on Dec. 13, 2010, the entire contents of which are incorporated herein by reference.

FIELD

The embodiments discussed herein are related to an antenna used for a mobile terminal.

BACKGROUND

In recent years, mobile terminals, such as a cellular phone, have become more sophisticated in functionality, and for example, are required to be adapted to broadband communication so as to be capable of coping with frequency bands of a plurality of wireless communication systems. Further, the mobile terminals are required e.g. to be reduced in size so as to be easily portable.

Some mobile terminals have a plurality of antennas in order to be adapted to broadband communication. For example, a mobile terminal covers the communication bands by the plurality of antennas, respectively, to thereby realize broadband communication. In this case, a space within the mobile terminal for mounting the antennas becomes larger, which increases the size of the mobile terminal.

Further, the antenna has a trade-off relation between the frequency of wireless communication and the antenna size. For example, to cover a low frequency band by a plate antenna, the antenna is increased in size, which increases the size of a mobile terminal.

Conventionally, there have been proposed an antenna device which is reduced in size, and is adapted to low frequencies and a wider bandwidth, and a mobile electronic device equipped with the antenna device (see e.g. Japanese Laid-Open Patent Publication No. 2006-279530).

As described above, the antenna has a problem that to cover broadband communication, the size thereof is increased.

SUMMARY

According to an aspect of the invention, there is provided an antenna having a radiator which is in a loop form having a plate shape and includes a first connection portion and a second connection portion, and a switch configured to couple the second connection portion to the first connection portion, or couple the second connection portion to ground.

The objects and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Figure 1:
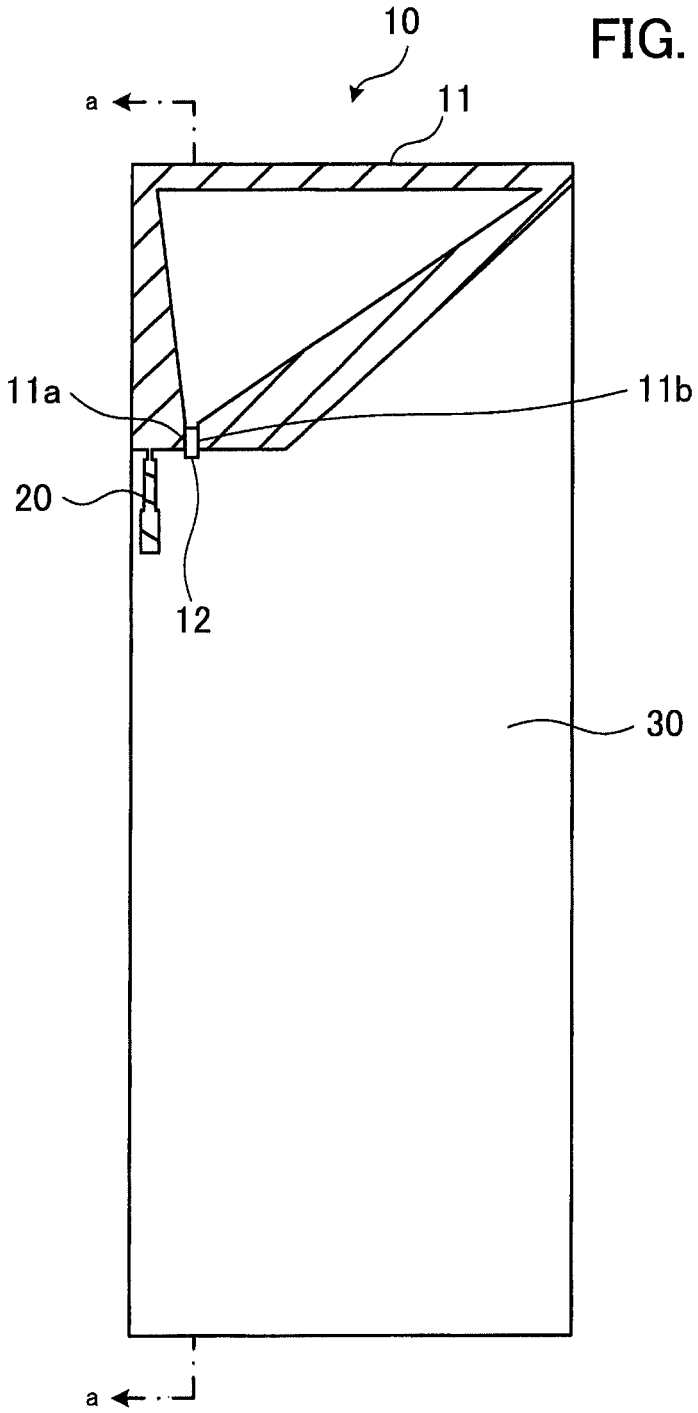
FIG. 1 is a plan view of an example of an antenna according to a first embodiment.

Embodiments of the present invention will be explained below with reference to the accompanying drawings, wherein like reference numerals refer to like elements throughout.

[a] First Embodiment

FIG. 1 is a plan view of an example of an antenna according to a first embodiment. FIG. 1 illustrates an antenna 10. FIG. 1 further illustrates a feeding line 20 and a substrate 30. The antenna 10 and the feeding line 20 are formed e.g. on the substrate 30.

The antenna 10 includes a radiation section 11 and a switch unit 12. The radiation section 11 includes connection portions 11*a* and 11*b*, and is e.g. in a loop form having a triangular shape. The sides of the loop form (e.g. the sides of a triangle) are plate-shaped, and each has some width. The connection portions 11*a* and 11*b* are provided e.g. on an open end portion of the loop form. Note that the shape of the radiation section 11 is not limited to a triangular shape, but may be a square shape or a circular shape.

The switch unit 12 couples the connection portion 11*b* to the connection portion 11*a* by a signal input from the outside. Further, the switch unit 12 couples the connection portion 11*b* e.g. to a ground formed on the rear side of the substrate 30 by a signal input from the outside. The switch unit 12 is provided e.g. between the connection portions 11*a* and 11*b*.

The feeding line 20 feeds a signal to be sent by wireless transmission via the antenna 10 to the radiation section 11. The feeding line 20 receives the signal e.g. from a semiconductor device, not illustrated in FIG. 1, and feeds the received signal to the radiation section 11. The feeding line 20 is formed by e.g. a microstrip line.

The substrate 30 is e.g. a PCB (printed circuit board) having a thickness of 1 mm. The substrate 30 has a dielectric constant of 4.3, and a dielectric dissipation factor of 0.015, for example. Further, the antenna 10, the feeding line 20, and the ground formed on the substrate 30 are formed of e.g. copper foil, and the thickness of the copper foil is e.g. 35 μm. The substrate 30 is incorporated in a mobile terminal such as a cellular phone.

Figure 2:
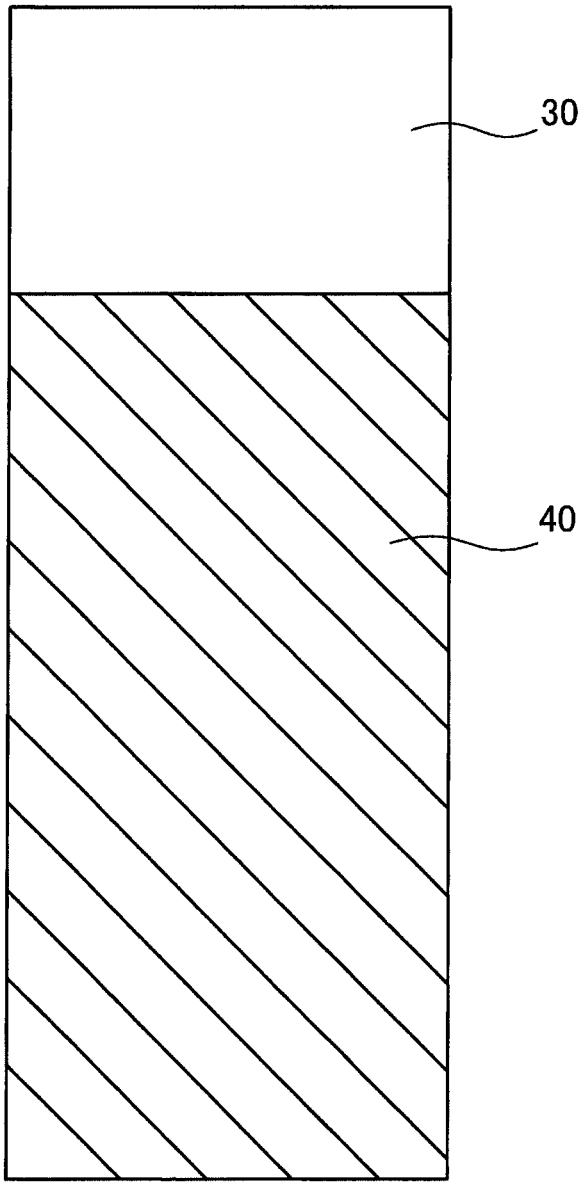
FIG. 2 is a bottom view of the example of the antenna illustrated in FIG. 1.

FIG. 2 is a bottom view of the example of the antenna illustrated in FIG. 1. In FIG. 2, the same component elements as those in FIG. 1 are denoted by the same reference numerals, and description thereof is omitted.

As illustrated in FIG. 2, a ground 40 is formed on a surface of the substrate 30 opposite from the surface having the antenna 10 formed thereon. The ground 40 is formed e.g. flatly on the substrate 30.

The ground 40 is formed so as not to overlap the radiation section 11. For example, the radiation section 11 is formed on a surface opposite from a portion, where the ground 40 is not formed, of the surface illustrated in FIG. 2.

Figure 3:
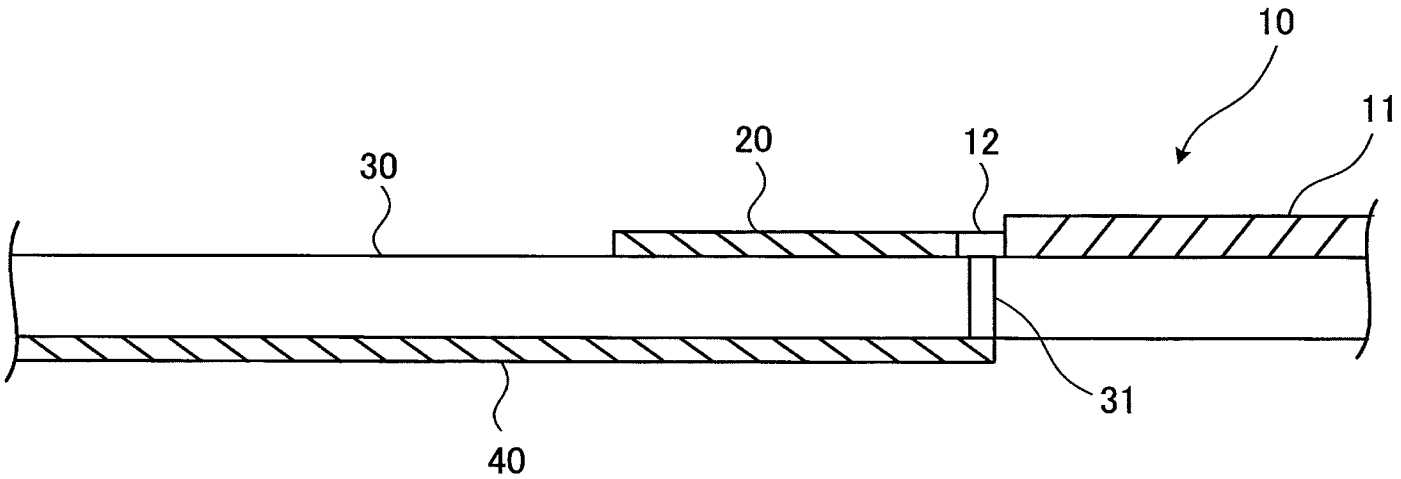
FIG. 3 is a cross-sectional view of the example of the antenna illustrated in FIG. 1.

FIG. 3 is a cross-sectional view of the example of the antenna illustrated in FIG. 1. FIG. 3 illustrates part of the cross section taken along a-a in FIG. 1. In FIG. 3, the same component elements as those in FIGS. 1 and 2 are denoted by the same reference numerals, and description thereof is omitted.

As illustrated in FIG. 3, the substrate 30 has a through hole 31 formed therein. The through hole 31 couples, i.e., extends between and connects the switch unit 12 and the ground 40. This causes the connection portion 11*b* of the radiation section 11 to be coupled to the ground 40 via the through hole 31, by switching the connection of the switch unit 12.

By the way, in the mobile terminal, such as a cellular phone, a frequency band used by the mobile terminal becomes wider along with increased diversity of communication including wireless communication by phone call and wireless data communication by a LAN (local area network). For example, a cellular phone is sometimes required to perform communication using a frequency band from 0.7 GHz to 6 GHz.

Now, a plate antenna can cover broadband communication by one antenna, as described hereinafter. For example, the plate antenna can cover communication using a broad bandwidth from 0.85 GHz to 6 GHz. Further, a loop antenna is adapted to a narrow bandwidth, but can cover communication using a low bandwidth without increasing the size thereof, as described hereinafter. For example, the loop antenna can cover communication using a bandwidth from 0.7 GHz to 0.85 GHz.

The antenna 10 illustrated in FIGS. 1 to 3 has characteristics of the plate antenna when the connection section 11*b* and the connection section 11*a* are coupled by the switch unit 12. Further, when the connection section 11*b* and the ground are connected by the switch unit 12, the antenna 10 has characteristics of the loop antenna.

That is, the antenna 10 can have characteristics of the plate antenna and that of the loop antenna by switching the connection of the switch unit 12. This enables the antenna 10 to cover broadband communication without increasing the size thereof. For example, the antenna 10 can cover communication using a bandwidth from 0.7 GHz to 6 GHz by one antenna without increasing the size thereof.

Hereinafter, a description will be given of characteristics of the plate antenna and the loop antenna. First, the characteristics of the plate antenna will be described.

Figure 4:
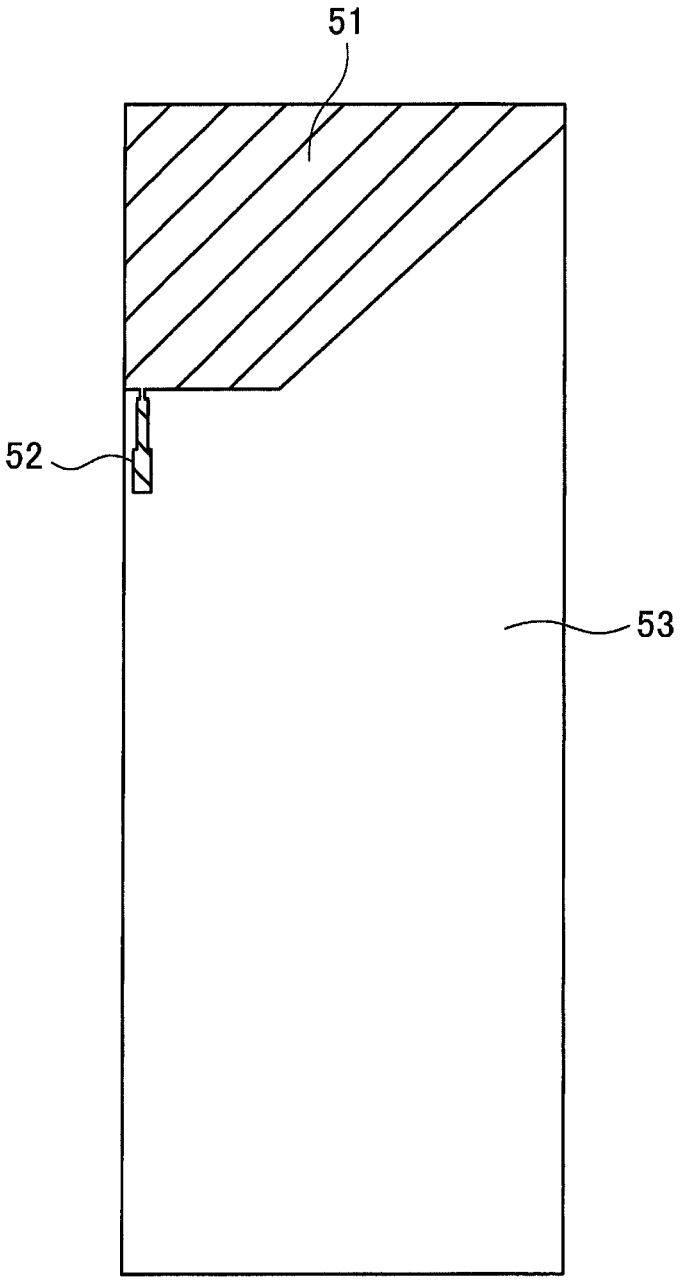
FIG. 4 is a plan view of an example of a plate antenna.

FIG. 4 is a plan view of an example of the plate antenna. FIG. 4 illustrates a plate antenna 51, a feeding line 52, and a substrate 53. The plate antenna 51 and the feeding line 52 are formed e.g. on the substrate 53.

The feeding line 52 feeds a signal sent by wireless transmission via the plate antenna 51 to the plate antenna 51. The feeding line 52 receives a signal e.g. from a semiconductor device, not illustrated in FIG. 4, and feeds the received signal to the plate antenna 51.

Figure 5:
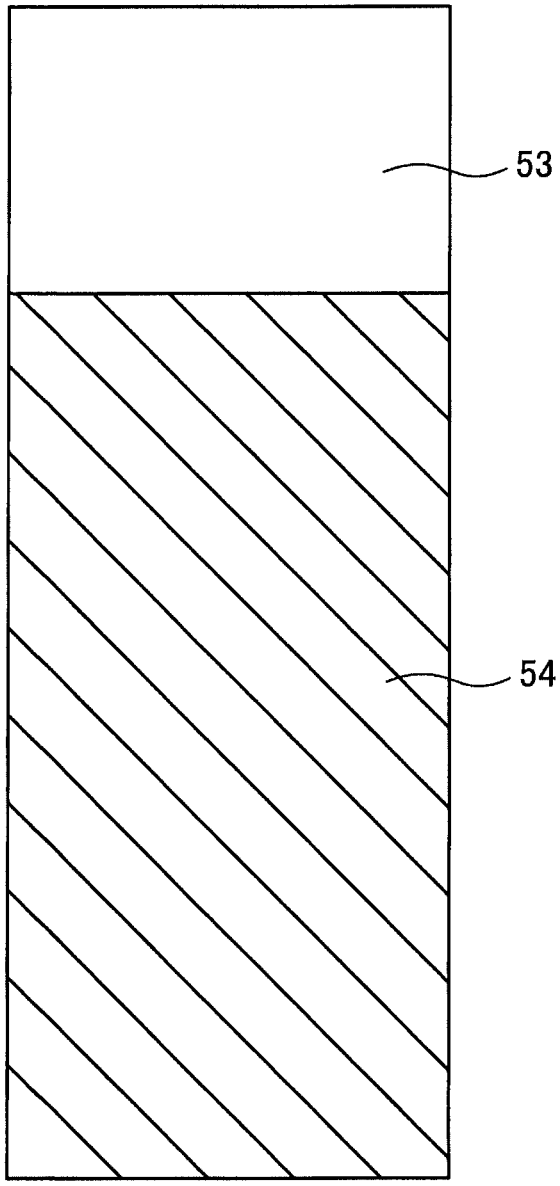
FIG. 5 is a bottom view of the example of the plate antenna illustrated in FIG. 4.

FIG. 5 is a bottom view of the example of the plate antenna illustrated in FIG. 4. In FIG. 5, the same component elements as those in FIG. 4 are denoted by the same reference numerals, and description thereof is omitted.

As illustrated in FIG. 5, a ground 54 is formed on a surface of the substrate 53 opposite from a surface having the antenna 51 formed thereon. The ground 54 is formed e.g. flatly on the substrate 53. The plate antenna 51 is formed on a surface opposite from a portion, where the ground 54 is not formed, of the surface illustrated in FIG. 5.

Figure 6:
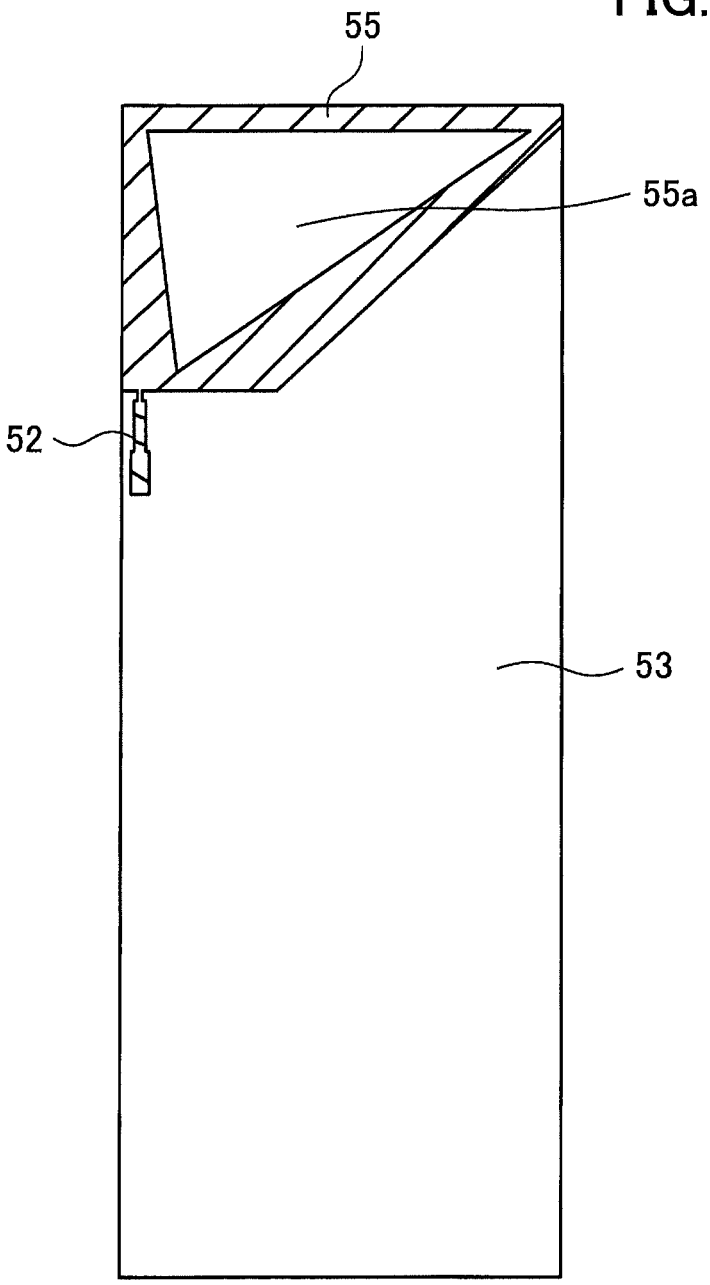
FIG. 6 is a plan view of an example of a plate antenna formed by hollowing a central portion of the plate antenna illustrated in FIG. 4.

FIG. 6 is a plan view of an example of a plate antenna formed by hollowing a central portion of the plate antenna illustrated in FIG. 4. In FIG. 6, the same component elements as those in FIG. 4 are denoted by the same reference numerals, and description thereof is omitted.

The plate antenna 55 illustrated in FIG. 6 is an antenna formed by hollowing the central portion of the plate antenna 51 illustrated in FIG. 4. The plate antenna 55 has an opening 55*a*, and has the same triangular shape as that of the antenna 10 illustrated in FIG. 1. The ground 54 similar to that illustrated in FIG. 5 is formed on a surface of the substrate 53 opposite from the surface having the plate antenna 55 formed thereon.

Figure 7:
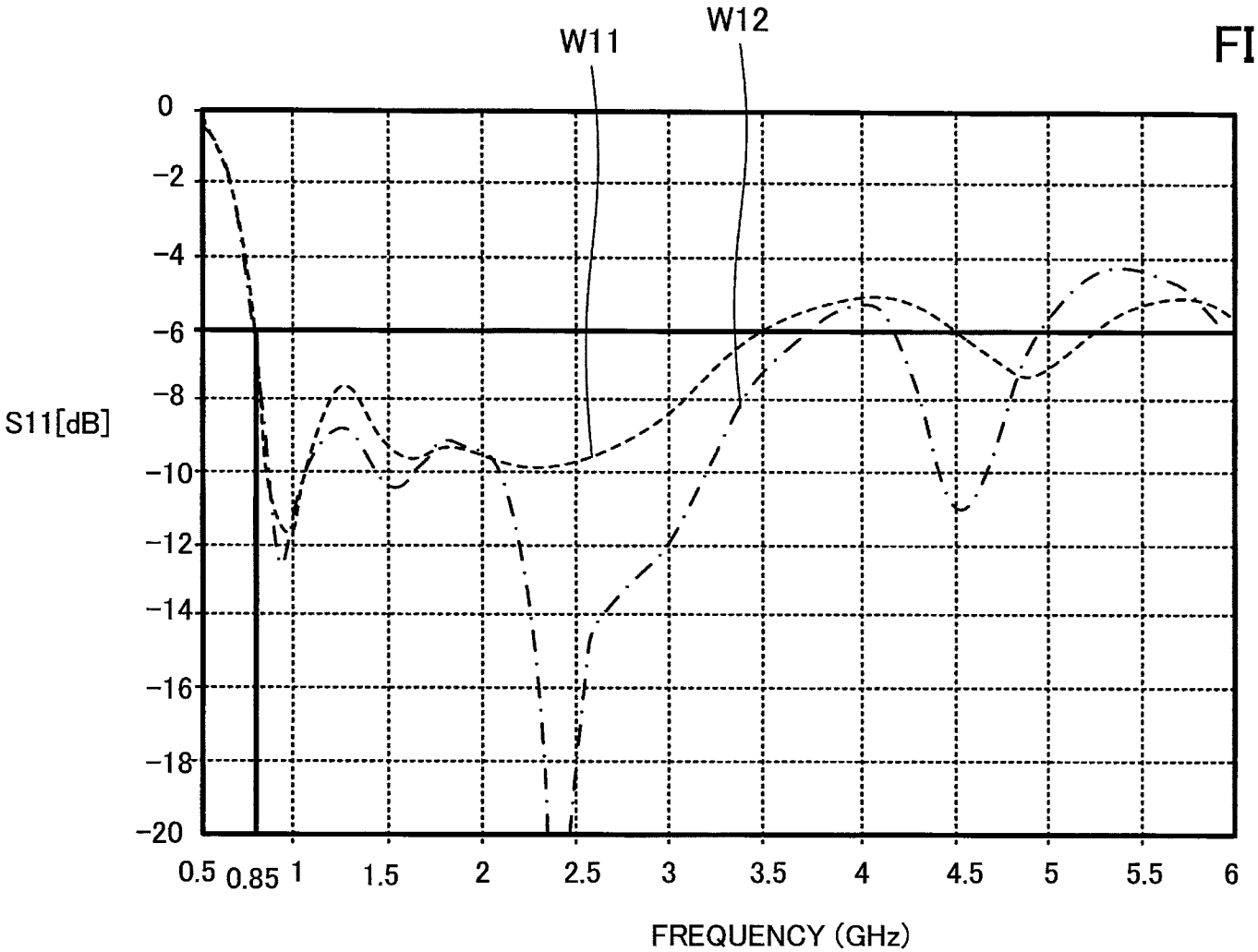
FIG. 7 illustrates return loss of the plate antenna and the plate antenna having the hollowed central portion.

FIG. 7 illustrates return loss of the plate antenna and those of the plate antenna having the hollowed central portion. In FIG. 7, the horizontal axis indicates the frequency, and the vertical axis indicates the return loss (S11 parameter). In the illustrated example, it is assumed that a target value of the return loss of the antenna is not higher than −6 dB.

A waveform W11 illustrated in FIG. 7 indicates the return loss of the plate antenna 51 illustrated in FIG. 4. A waveform W12 indicates the return loss of the plate antenna 55 having the hollowed central portion illustrated in FIG. 6.

As indicated by the waveform W11, the plate antenna 51 can satisfy the target return loss in a broad bandwidth from 0.85 GHz to 6 GHz. Note that although in FIG. 7, the return loss exceeds the target return loss by approximately 1 dB at some frequencies, it can be reduced to not higher than the target of −6 dB by optimizing the plate antenna 51 according to the impedance matching and the antenna shape.

As indicated by the waveform W12, even though the plate antenna 55 has the central portion thereof hollowed, it has the same broadband characteristics as those of the plate antenna 51. That is, the plate antenna 51 having a hollowed central portion similarly to the antenna 55 can also satisfy the target return loss in the broad bandwidth from 0.85 GHz to 6 GHz. Note that although in FIG. 7, the return loss exceeds the target return loss by approximately 2 dB at some frequencies, the return loss can be reduced to not higher than the target of −6 dB by optimizing the plate antenna 55 as mentioned above.

Figure 8:
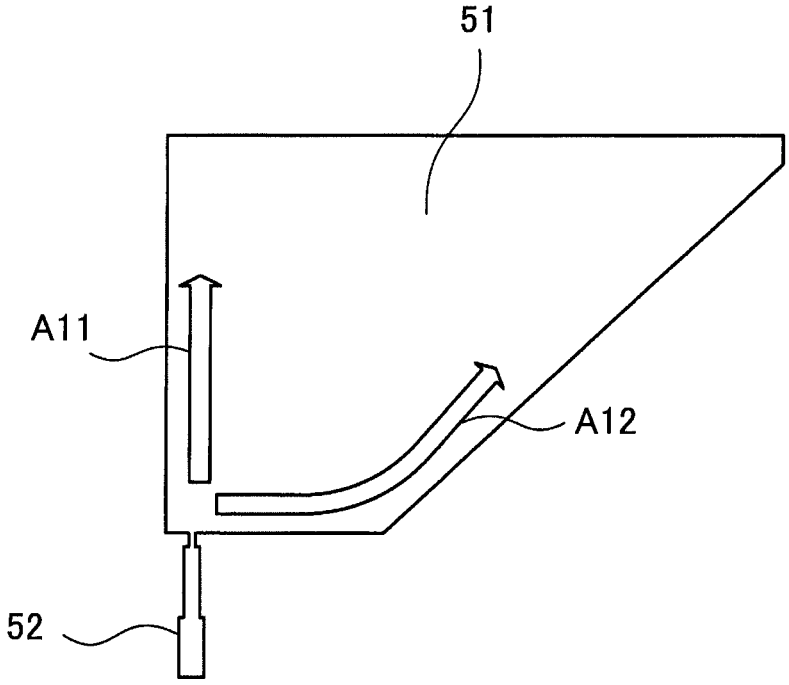
FIG. 8 illustrates current flowing through the plate antenna.

FIG. 8 illustrates current flowing through the plate antenna. In FIG. 8, the same component elements as those in FIG. 4 are denoted by the same reference numerals, and description thereof is omitted. Arrows A11 and A12 illustrated in FIG. 8 indicate signal current flowing through the plate antenna 51. In the plate antenna 51, most of the signal current flows through edge portions as indicated by the arrows A11 and A12.

Figure 9:
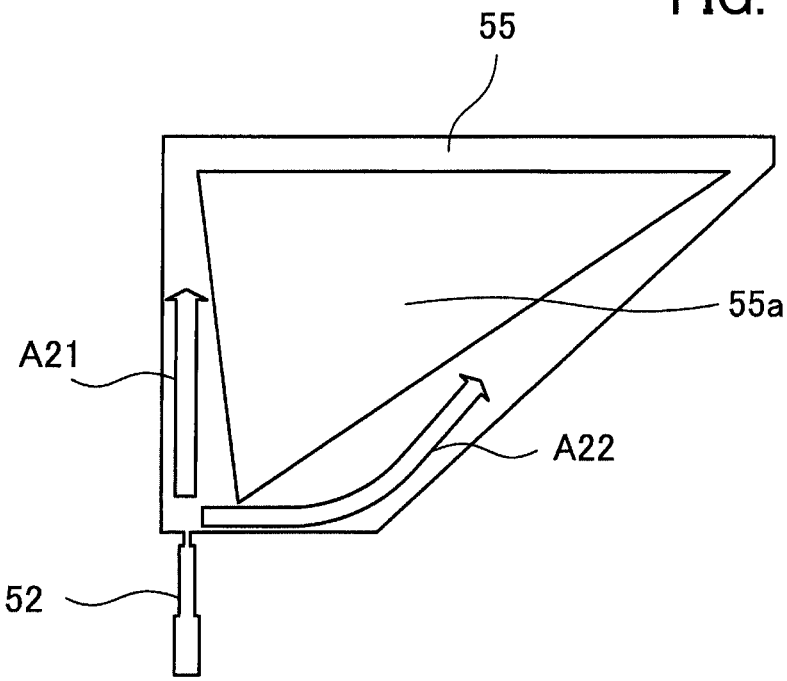
FIG. 9 illustrates current flowing through the plate antenna having the hollowed central portion.

FIG. 9 illustrates current flowing through the plate antenna having the hollowed central portion. In FIG. 9, the same component elements as those in FIG. 6 are denoted by the same reference numerals, and description thereof is omitted. Arrows A21 and A22 indicate signal power flowing through the plate antenna 55.

As described with reference to FIG. 8, most of signal current flows through the edge portions of the plate antenna 51. Further, as illustrated in the plate antenna 55 in FIG. 9, even if the central portion is hollowed, the same signal current as that illustrated in FIG. 8 flows. That is, the plate antenna 55 having the hollowed central portion can have the same broadband characteristics as those of the plate antenna 51 as described with reference to FIG. 7.

Note that the signal current flows with some degree of width from the edge portions of the plate antenna 51. Therefore, if the hollowed portion of the plate antenna 55 is increased to reduce the width of each edge portions (each side of the triangular shape), the plate antenna 55 becomes largely different in current distribution from the plate antenna 51. For this reason, the plate antenna 55 is formed to have the central portion hollowed such that the loop form is plate-shaped and has some width so as not to be largely different in current distribution from the plate antenna 51 to thereby have the same broadband characteristics as those of the plate antenna 51.

Next, a description will be given of the characteristics of the loop antenna.

Figure 10:
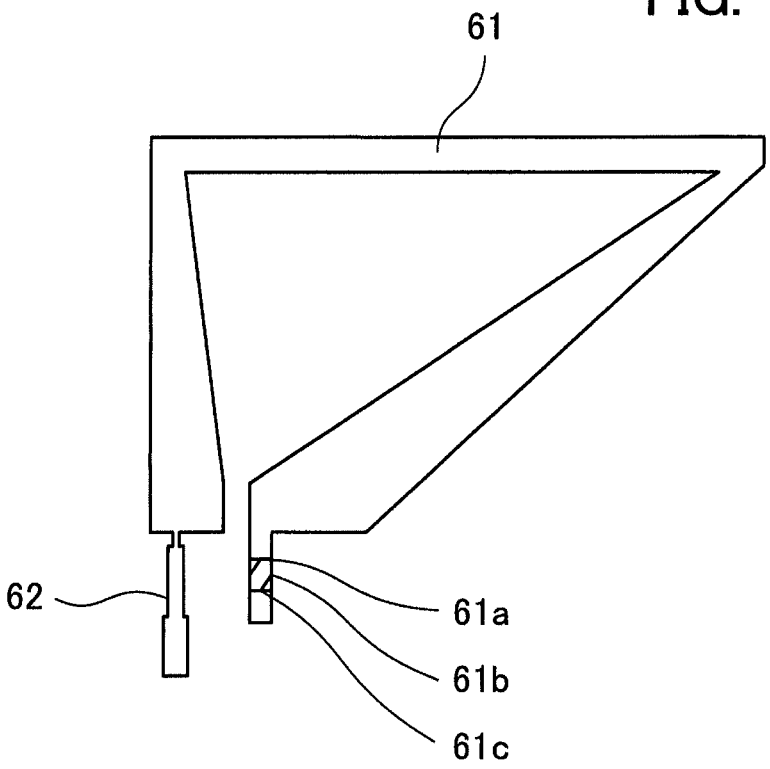
FIG. 10 is a plan view of an example of a loop antenna.

FIG. 10 is a plan view of an example of the loop antenna. As illustrated in FIG. 10, a loop antenna 61 includes a connection portion 61*a*, an inductor 61*b*, and a pattern 61*c*. FIG. 10 further illustrates a feeding line 62. The loop antenna 61, the feeding line 62, and the pattern 61*c* are formed e.g. on a substrate. Further, a ground is formed on a surface of the substrate opposite from a surface having the loop antenna 61 and the feeding line 62 formed thereon.

A signal to be sent by wireless transmission is fed to the loop antenna 61 via the feeding line 62. The connection portion 61*a* of the loop antenna 61 is coupled to the pattern 61*c* via the inductor 61*b*. The pattern 61*c* is coupled to the ground formed on the other surface of the substrate e.g. via the through hole.

Figure 11:
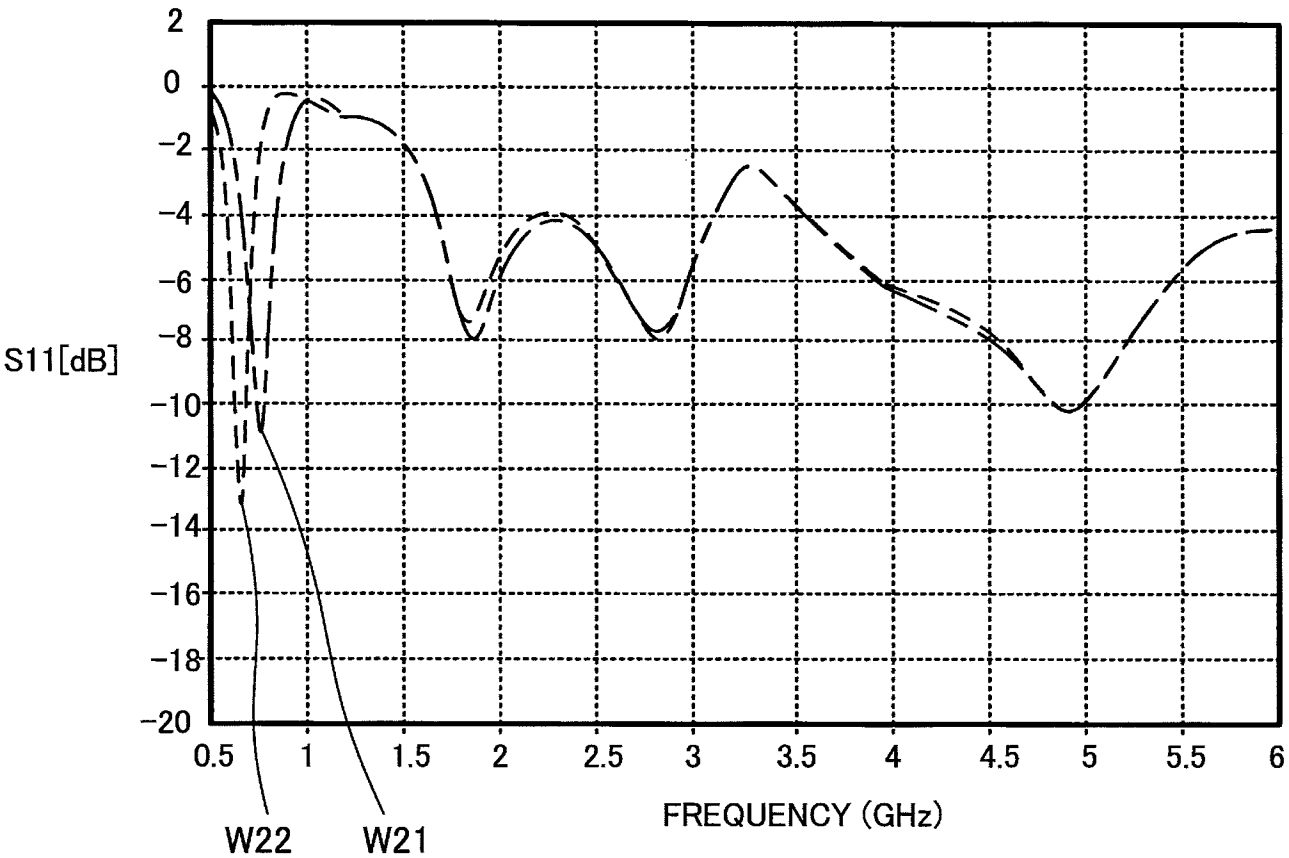
FIG. 11 illustrates return loss of the loop antenna.

FIG. 11 illustrates return loss of the loop antenna. In FIG. 11, the horizontal axis indicates the frequency, and the vertical axis indicates the return loss. In the illustrated example, it is assumed that a target of the return loss of the antenna is not higher than −6 dB.

Waveforms W21 and W22 illustrated in FIG. 11 each indicate the return loss of the loop antenna 61 illustrated in FIG. 10. The waveform W21 indicates the return loss of the loop antenna 61 in a case where an inductance value of the inductor 61*b* is set to 24 nH. The waveform W22 indicates the return loss of the loop antenna 61 in a case where the inductance value of the inductor 61*b* is set to 50 nH.

As indicated by the waveforms W21 and W22, in the loop antenna 61, it is possible to satisfy the return loss not higher than −6 dB in a bandwidth from 0.7 GHz to 0.85 GHz. For example, by switching the inductance value of the inductor 61*b*, the loop antenna 61 can satisfy the return loss not higher than −6 dB in a continuous bandwidth from 0.7 GHz to 0.85 GHz.

As described above, the antenna 10 illustrated in FIGS. 1 to 3 has characteristics of the plate antenna having the hollowed central portion when the connection portions 11*b* and 11*a* are coupled. Further, the antenna 10 has characteristics of the loop antenna when the connection portions 11*b* and the ground are coupled. This enables the antenna 10 to cover communication in a low bandwidth by the loop antenna, which cannot be covered by the plate antenna, and therefore cover broadband communication without increasing the size thereof.

Next, a description will be given of an example of the switch unit 12 of the antenna 10.

Figure 12:
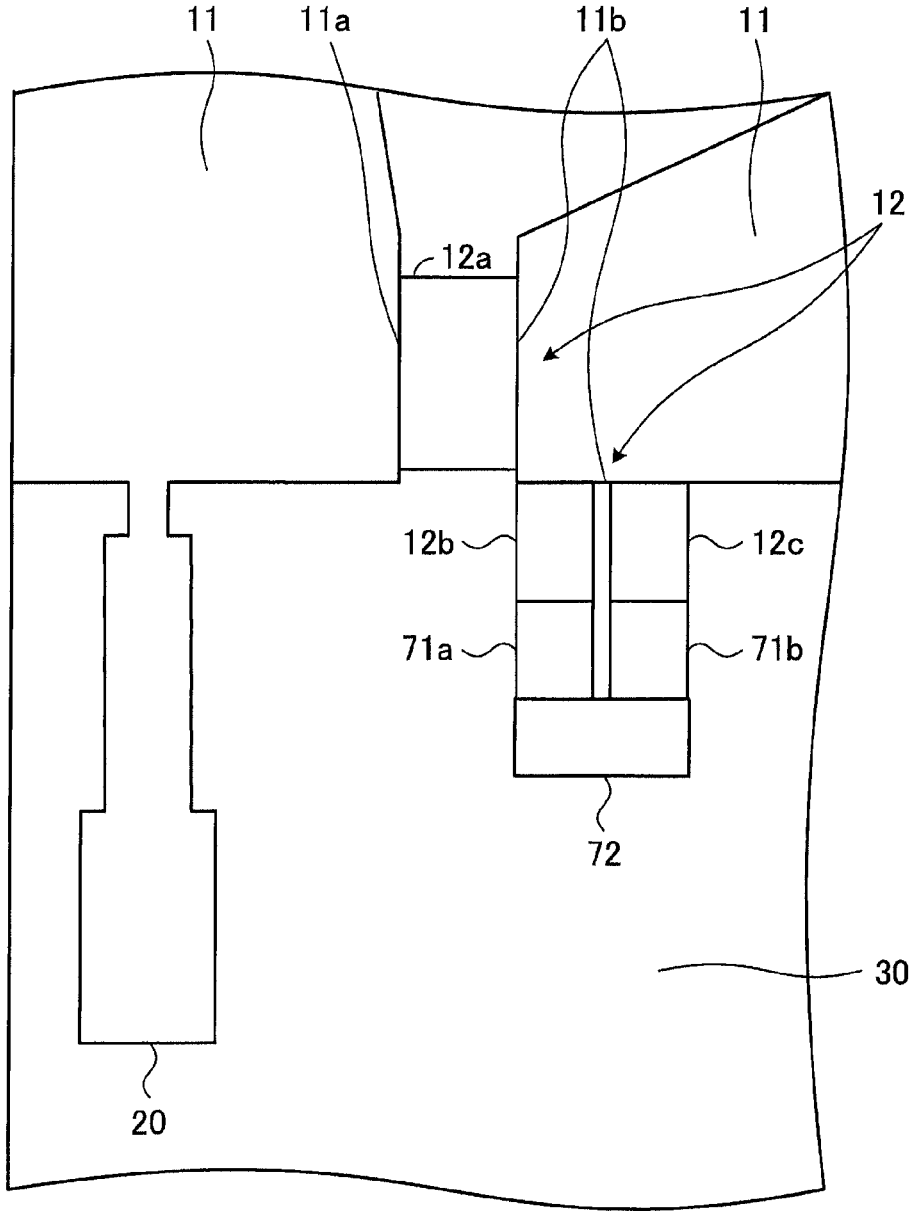
FIG. 12 illustrates an example of a switch unit of the antenna.

FIG. 12 illustrates an example of a switch unit of the antenna. In FIG. 12, the same component elements as those in FIG. 1 are denoted by the same reference numerals, and description thereof is omitted.

As illustrated in FIG. 12, the switch unit 12 includes switches 12*a* to 12*c*. The substrate 30 has inductors 71*a* and 71*b* mounted thereon, and has a pattern 72 formed thereon. The switch 12*a* is provided between the connection portions 11*a* and 11*b* to switch on and off the connection between the connection portions 11*a* and 11*b*. The switch 12*b* is provided between the connection portion 11*b* and the inductor 71*a* to switch on and off the connection between the connection portion 11*b* and one end of the inductor 71*a*. The switch 12*c* is provided between the connection portion 11*b* and the inductor 71*b* to switch on and off the connection between the connection portion 11*b* and one end of the inductor 71*b*.

The other ends of the inductors 71*a* and 71*b* are coupled to the pattern 72. The inductor 71*a* has an inductance of e.g. 24 nH, and the inductor 71*b* has an inductance of e.g. 50 nH.

The pattern 72 is coupled to the ground 40 formed on the other surface of the substrate 30 via the through hole. Therefore, the connection portion 11*b* is coupled to the ground 40 via one of the inductors 71*a* and 71*b* by switching on and off of the switches 12*b* and 12*c*.

The switches 12*a* to 12*c* are each switched on and off by a signal output from a CPU (central processing unit), not illustrated, mounted on the substrate 30. The CPU controls the on and off of the switches 12*a* to 12*c* e.g. according to a communication mode in which the cellular phone is to perform wireless communication. For example, the CPU controls the switches 12*a* to 12*c* according to a communication mode, such as wireless communication by phone call and wireless data communication via a LAN (local area network).

The switch unit 12 can be formed e.g. by an MEMS (micro electro mechanical system) switch of SP3T (single-pole three-throw). Further, the switch unit 12 can be also formed e.g. by a PIN diode (p-intrinsic-n diode).

Figure 13:
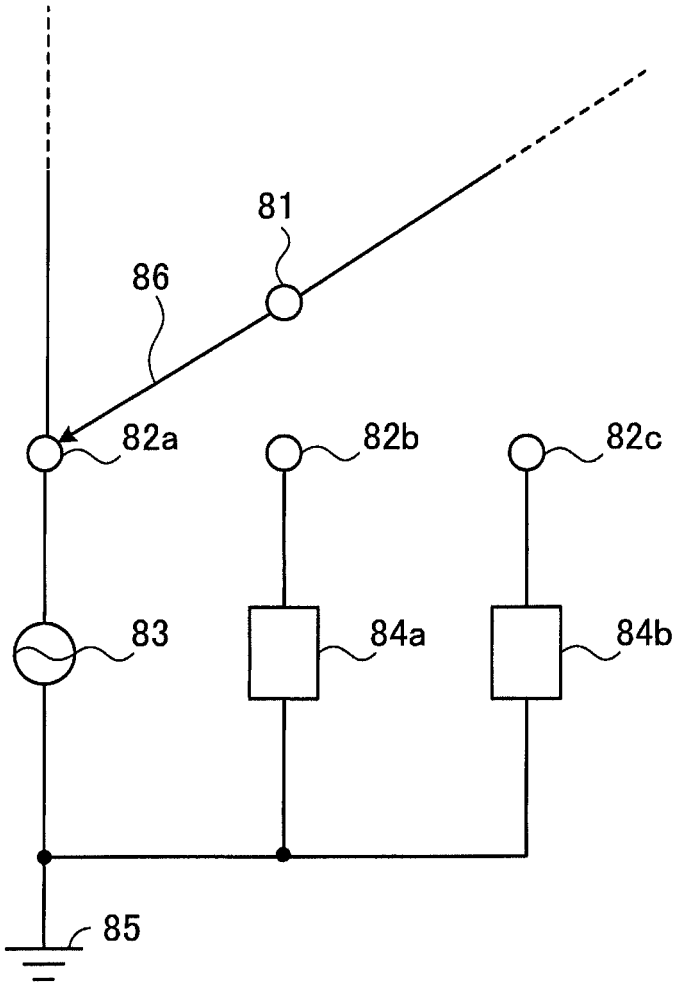
FIG. 13 illustrates connection of the switch unit.

FIG. 13 illustrates connection of the switch unit. A terminal 81 illustrated in FIG. 13 corresponds to the connection portion 11*b* illustrated in FIG. 12. A terminal 82*a* corresponds to the connection portion 11*a* illustrated in FIG. 12. A terminal 82*b* corresponds to the connection portion of the switch 12*b* coupled to the inductor 71*a* illustrated in FIG. 12. A terminal 82*c* corresponds to the connection portion of the switch 12*c* coupled to the inductor 71*b* illustrated in FIG. 12.

A signal source 83 corresponds to e.g. a device which feeds a signal to the feeding line 20. An inductor 84*a* corresponds to the inductor 71*a* illustrated in FIG. 12, and an inductor 84*b* corresponds to the inductor 71*b* illustrated in FIG. 12. A ground 85 corresponds to the ground 40.

An arrow 86 represents the on/off states (connection states) of the switches 12*a* to 12*c*. In FIG. 13, the arrow 86 indicates a state in which the switch 12*a* is switched on, and the switches 12*b* and 12*c* are switched off. Note that when the switch 12*b* is switched on, and the switches 12*a* and 12*c* are switched off, the head of the arrow 86 is coupled to the terminal 82*b*. Further, when the switch 12*c* is switched on, and the switches 12*a* and 12*b* are switched off, the head of the arrow 86 is coupled to the terminal 82*c*.

One of the switches 12*a* to 12*c* is on. Therefore, when the switch 12*a* is switched on, the switches 12*b* and 12*c* are switched off. Further, when the switch 12*b* is switched on, the switches 12*a* and 12*c* are switched off. When the switch 12*c* is switched on, the switches 12*a* and 12*b* are switched off.

That is, as indicated by the arrow 86, when the switch 12*a* is switched on, the antenna 10 serves as a plate antenna having a hollowed central portion. Further, when the switch 12*b* is switched on, the antenna 10 serves as a loop antenna. Further, when the switch 12*c* is switched on, the antenna 10 serves as a loop antenna having band characteristics different from those indicated when the switch 12*b* is switched on.

Figure 14:
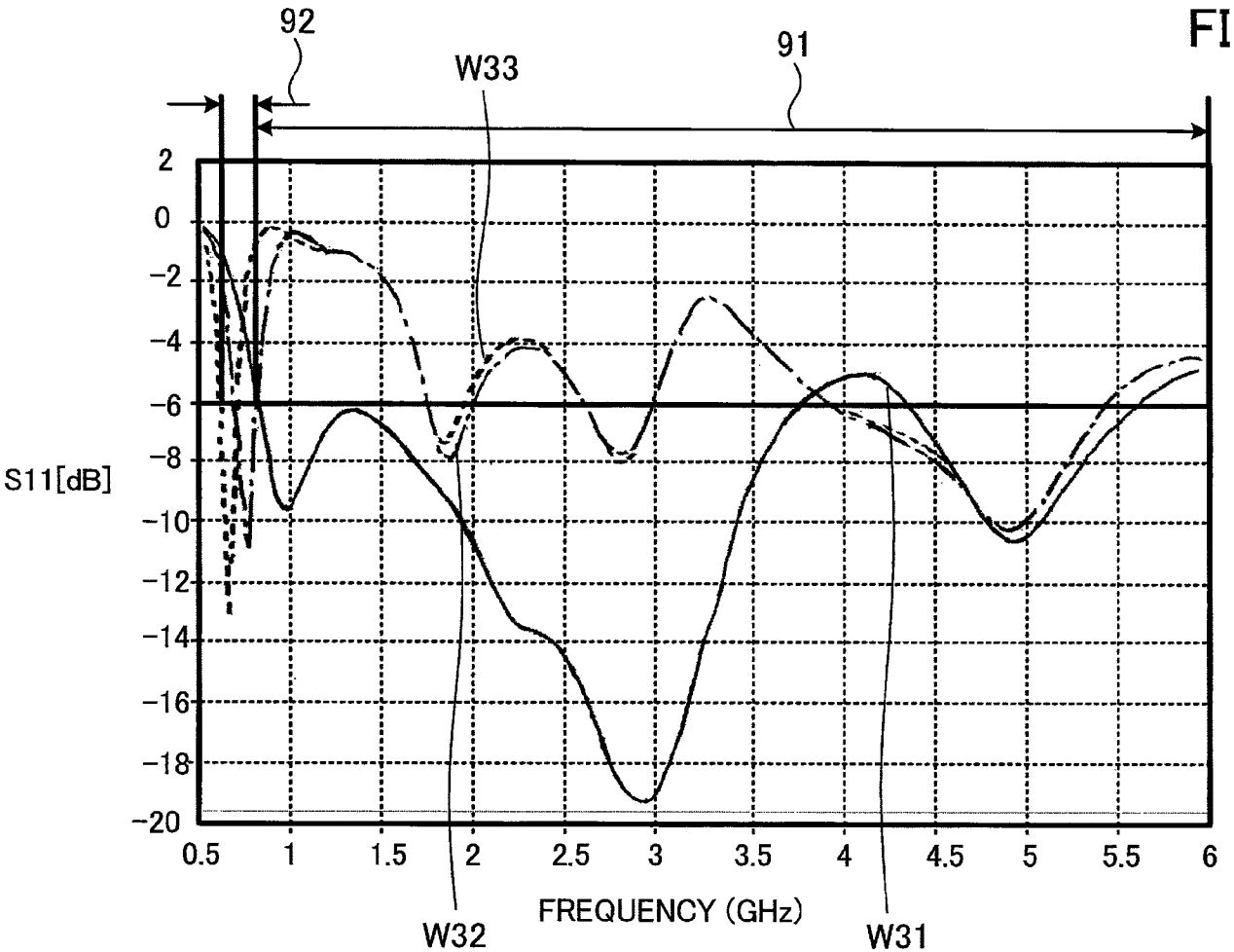
FIG. 14 illustrates return loss of the antenna described with reference to FIG. 12.

FIG. 14 illustrates return loss of the antenna described with reference to FIG. 12. In FIG. 14, the horizontal axis indicates the frequency, and the vertical axis indicates the return loss. In the illustrated example, it is assumed that a target of the return loss of the antenna is not higher than −6 dB.

A waveform W31 illustrated in FIG. 14 indicates the return loss of the antenna 10 when the switch 12*a* of those described with reference to FIG. 12 is switched on, and the switches 12*b* and 12*c* of the same are switched off. Referring to FIG. 13, the waveform W31 indicates the return loss of the antenna 10 when the terminal 81 and the terminal 82*a* are coupled.

In this case, the antenna 10 has characteristics of the plate antenna, and can satisfy the target return loss in a bandwidth from 0.85 GHz to 6 GHz, as indicated by an arrow 91 in FIG. 14. Although in FIG. 14, the return loss exceeds the target return loss by approximately 1 dB at some frequencies of the waveform W31, the return loss can be reduced to not higher than −6 dB by optimizing the antenna 10 as described hereinabove.

A waveform W32 indicates the return loss of the antenna 10 when the switch 12*b* of those described with reference to FIG. 12 is switched on, and the switches 12*a* and 12*c* of the same are switched off. The waveform W32 indicates the return loss of the antenna 10 when the terminal 81 and the terminal 82*b* in FIG. 13 are coupled. In this case, the antenna 10 has characteristics of the loop antenna, and can satisfy the target return loss in a bandwidth from 0.7 GHz to 0.75 GHz.

A waveform W33 indicates the return loss of the antenna 10 when the switch 12*c* of those described with reference to FIG. 12 is switched on, and the switches 12*a* and 12*b* of the same are switched off. The waveform W33 indicates the return loss of the antenna 10 when the terminal 81 and the terminal 82*c* in FIG. 13 are coupled. In this case, the antenna 10 has characteristics of the loop antenna, and can satisfy the target return loss in a bandwidth from 0.75 GHz to 0.85 GHz.

That is, by switching on one of the switches 12*b* and 12*c*, as indicated by an arrow 92 in FIG. 14, the antenna 10 can satisfy the target return loss in a bandwidth from 0.7 GHz to 0.85 GHz. Further, by switching on the switch 12*a*, as mentioned above, the antenna 10 can satisfy the target return loss in the bandwidth from 0.85 GHz to 6 GHz. That is, the antenna 10 can cover communication in the bandwidth from 0.7 GHz to 6 GHz by one antenna without increasing the size of the plate antenna of which a central portion is not hollowed and the loop antenna.

Next, a description will be given of the antenna matching.

Figure 15:
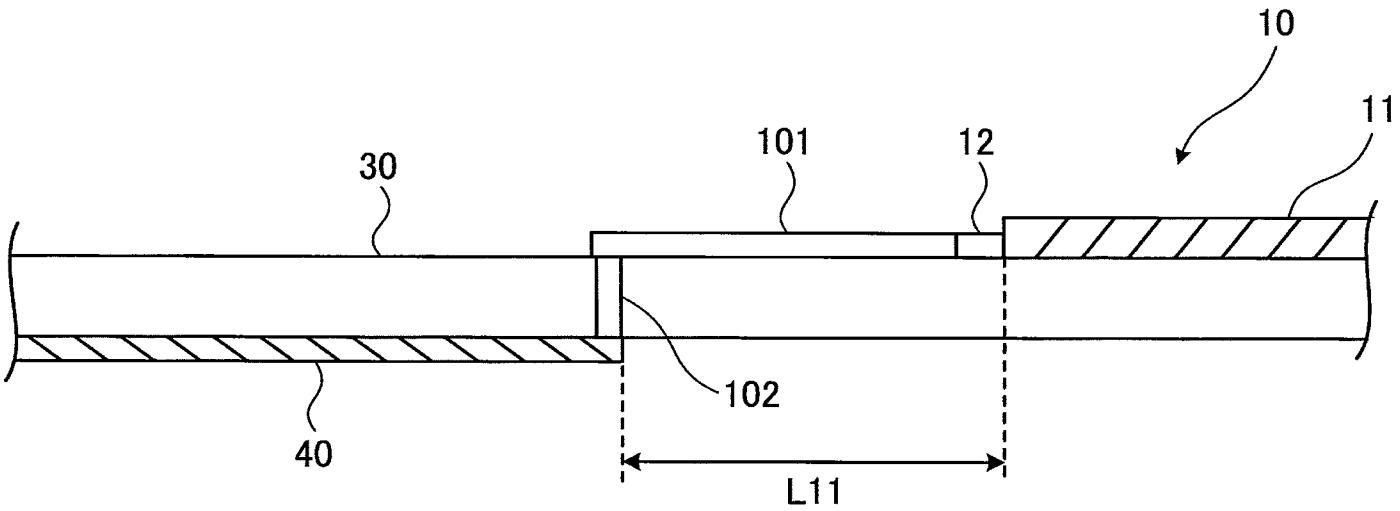
FIG. 15 illustrates antenna matching.

FIG. 15 illustrates antenna matching. In FIG. 15, the same component elements as those in FIG. 3 are denoted by the same reference numerals, and description thereof is omitted.

FIG. 15 differs from FIG. 3 in that a pattern 101 is coupled to the switch unit 12. The pattern 101 extends in a direction away from the radiation section 11. One end of the pattern 101 is coupled to the switch unit 12, and the other end is coupled to the ground 40 via a through hole 102.

Impedance matching is performed between the impedance of the device which outputs a signal and the impedance of a point of the feeding line 20 which receives a signal (hereinafter referred to as the impedance of the antenna 10). For example, the impedance of the device which outputs a signal and the impedance of the antenna 10 are made equal to 50Ω.

The impedance of the antenna 10 can be adjusted according to a distance between the radiation section 11 and the ground 40. For example, by changing a distance L11 illustrated in FIG. 15, it is possible to adjust the impedance of the antenna 10.

It is also possible to adjust the impedance of the antenna 10 according to the width and length of the feeding line 20. Further, the impedance of the antenna 10 can be adjusted according to the loop form of the radiation section 11 and the size of the hollowed portion.

As described above, the antenna 10 includes the radiation section 11 which is in a loop form having a plate shape and including the connection portions 11*a* and 11*b*, and the switch unit 12 which couples the connection portion 11*b* to the connection portion 11*a*, or couples the connection portion 11*b* to the ground. This enables the antenna 10 to have characteristics of the plate antenna and those of the loop antenna by switching the connection of the switch unit 12, to thereby make it possible to cover the communication in a broad bandwidth without increasing the size.

Note that although the above description has been given of the case in which two inductors are provided, this is not limitative. For example, the number of inductors may be one or more than two. Further, when a desired low band can be obtained, it is not necessary to provide an inductor.

[b] Second Embodiment

Next, a description will be given of a second embodiment with reference to drawings. In the second embodiment, part of the radiation section is bent e.g. at a right angle to further reduce the antenna in size.

Figure 16:
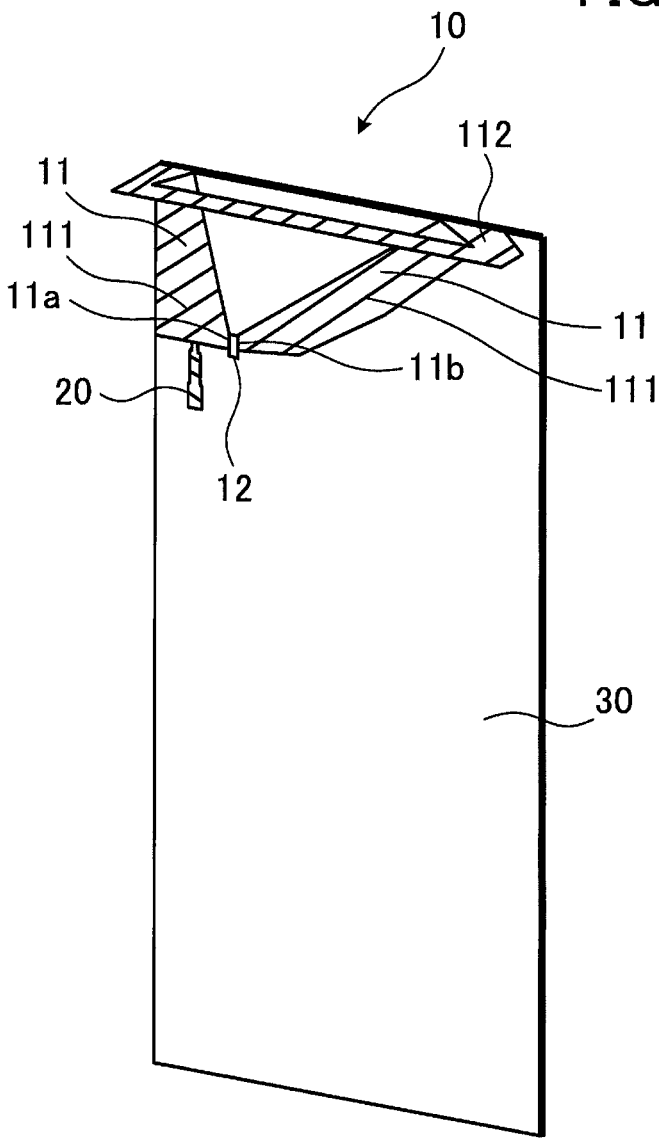
FIG. 16 is a perspective view of an example of an antenna according to a second embodiment.

FIG. 16 is a perspective view of an example of an antenna according to the second embodiment. In FIG. 16, the same component elements as those in FIG. 1 are denoted by the same reference numerals, and description thereof is omitted.

In the antenna 10 illustrated in FIG. 16, the radiation section 11 has a bent portion 112 which is bent at a predetermined angle with respect to a plate-shaped flat portion 111. The bent portion 112 is bent at an end of the substrate 30 where the radiation section 11 is formed, through 90 degrees toward a surface of the substrate 30 having the radiation section 11 formed thereon.

Figure 17:
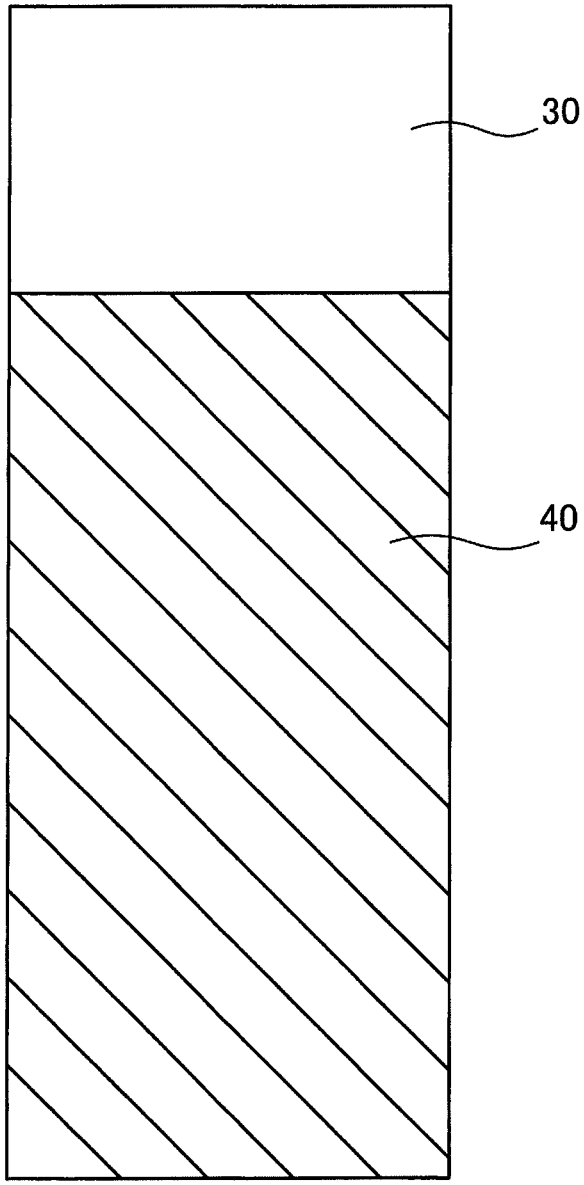
FIG. 17 is a bottom view of the example of the antenna illustrated in FIG. 16.

FIG. 17 is a bottom view of the example of the antenna illustrated in FIG. 16. In FIG. 17, the same component elements as those in FIG. 2 are denoted by the same reference numerals, and description thereof is omitted.

As illustrated in FIG. 17, the ground 40 is formed on a surface of the substrate 30 opposite from the surface having the antenna 10 thereon. The ground 40 is formed e.g. flatly on the substrate 30.

The ground 40 is formed so as not to overlap the radiation section 11. For example, the radiation section illustrated in FIG. 16 is formed on a surface opposite from a portion, where the ground 40 is not formed, of the surface illustrated in FIG. 17.

Figure 18:
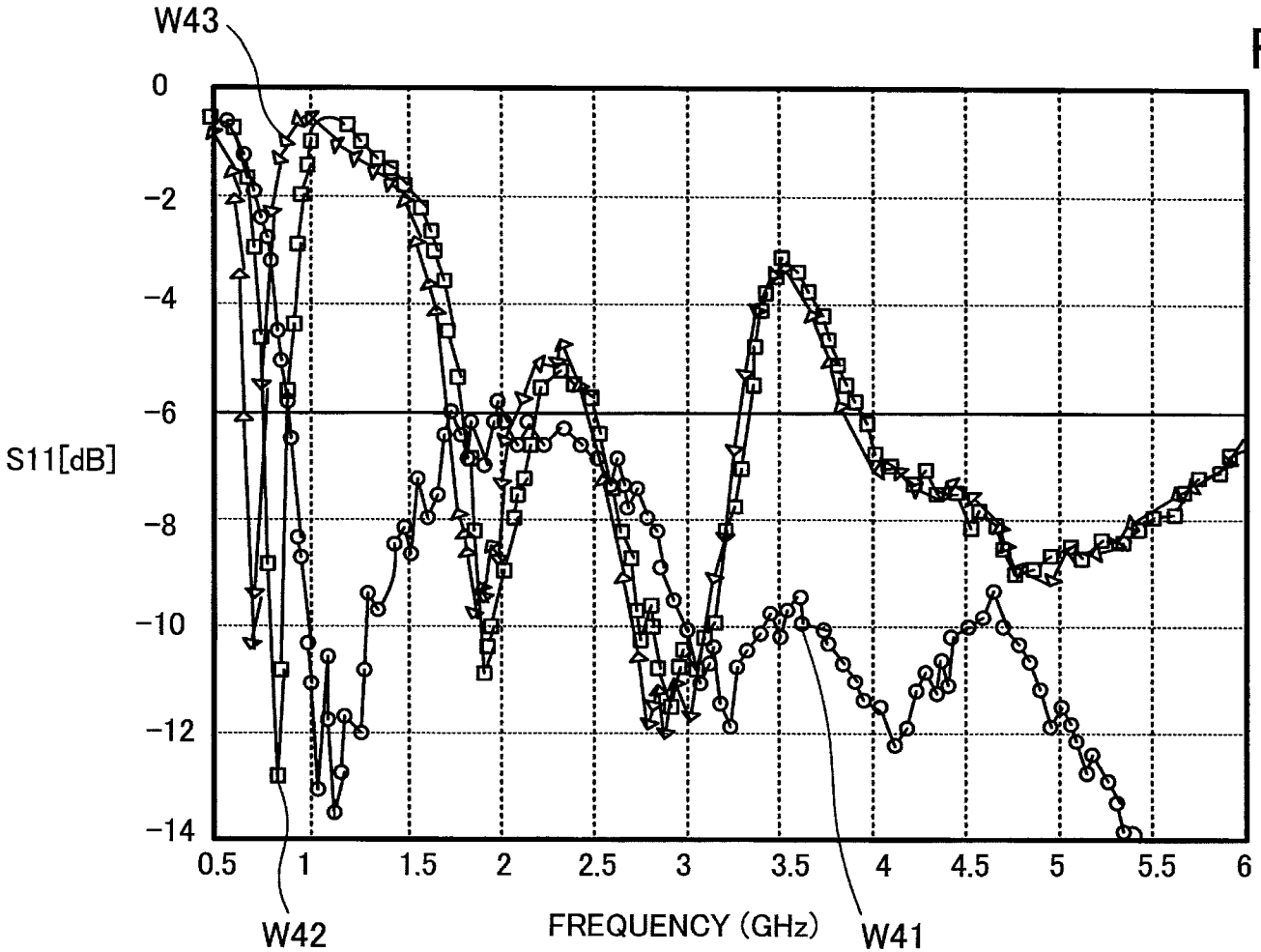
FIG. 18 illustrates return loss of the antenna illustrated in FIGS. 16 and 17.

FIG. 18 illustrates return loss of the antenna illustrated in FIGS. 16 and 17. In FIG. 18, the horizontal axis indicates the frequency, and the vertical axis indicates the return loss. In the illustrated example, it is assumed that a target of the return loss of the antenna is not higher than −6 dB.

A waveform W41 illustrated in FIG. 18 indicates the return loss of the antenna 10 when the connection portions 11*a* and 11*b* illustrated in FIG. 16 are coupled by the switch unit 12. A waveform W42 indicates the return loss of the antenna 10 when the connection portion 11*b* illustrated in FIG. 16 is coupled to the ground 40 by the switch unit 12 via a inductor having an inductance value of 30 nH. A waveform W43 indicates the return loss of the antenna 10 when the connection portion 11*b* illustrated in FIG. 16 is coupled to the ground 40 by the switch unit 12 via a inductor having an inductance value of 56 nH.

That is, the antenna 10 can satisfy the target return loss in a bandwidth from 0.85 GHz to 6 GHz by coupling the connection portion 11*b* and the connection portion 11*a*. Further, the antenna 10 can satisfy the target return loss in a bandwidth from 0.7 GHz to 0.85 GHz by coupling the connection portion 11*b* to the ground 40 by selecting between the inductors having respective different inductance values. That is, the antenna 10 can cover broadband communication even by bending part of the radiation section 11, and further, can be reduced in size by forming the radiation section 11 into a three-dimensional structure. Further, by downsizing the antenna 10, it is possible to increase a mounting area of the substrate 30.

Hereinafter, a description will be given of an example of the size of the antenna 10. The substrate of the antenna 10 illustrated in FIG. 16 is e.g. 50 mm in width and 120 mm in length. Further, the portion of the substrate 30 illustrated in FIG. 17, on which the ground 40 is not formed, is e.g. 50 mm in width and 20 mm in length.

Figure 19:
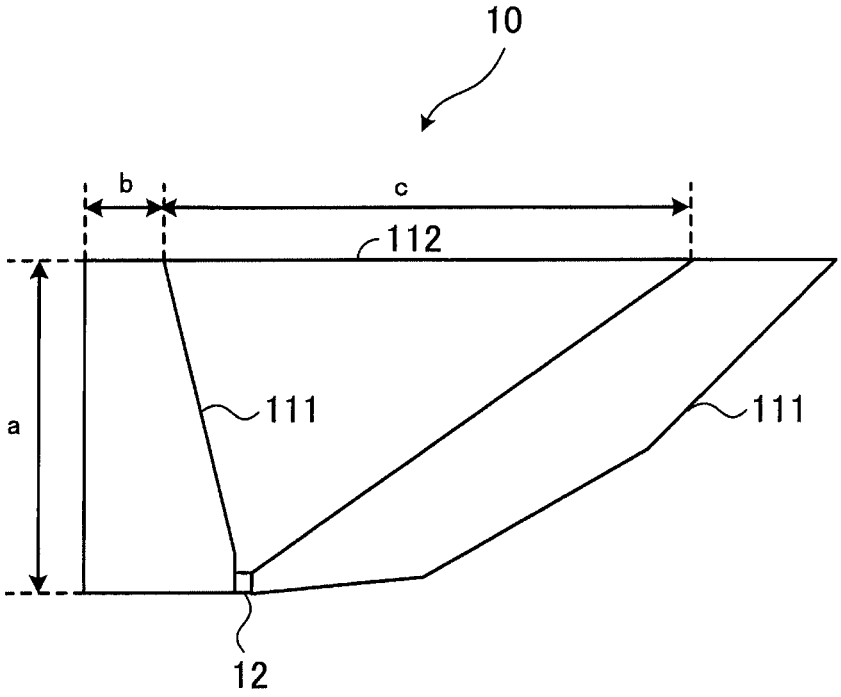
FIG. 19 is a plan view of the antenna illustrated in FIG. 16.

FIG. 19 is a plan view of the antenna illustrated in FIG. 16. In FIG. 19, the same component elements as those in FIG. 16 are denoted by the same reference numerals, and description thereof is omitted. The values of "a" to "c" illustrated in FIG. 19 are e.g. 20 mm, 4.6 mm, and 32.06 mm, respectively.

Figure 20:
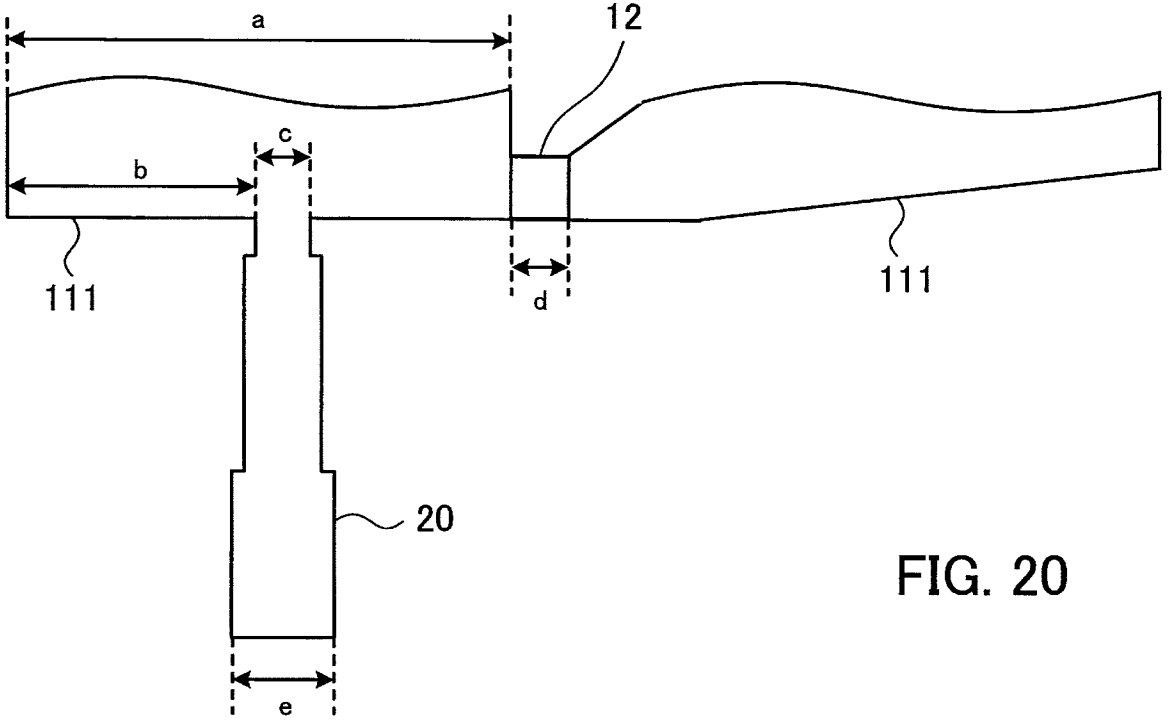
FIG. 20 is an enlarged view of a feeding line illustrated in FIG. 16.

FIG. 20 is an enlarged view of the feeding line illustrated in FIG. 16. In FIG. 20, the same component elements as those in FIG. 16 are denoted by the same reference numerals, and description thereof is omitted. The values of "a" to "e" illustrated in FIG. 20 are e.g. 9 mm, 4.4 mm, 1 mm, 1 mm, and 1.8 mm, respectively. Note that the values of "a" to "e" can be applied to the antenna 10 described in the first embodiment.

Figure 21:
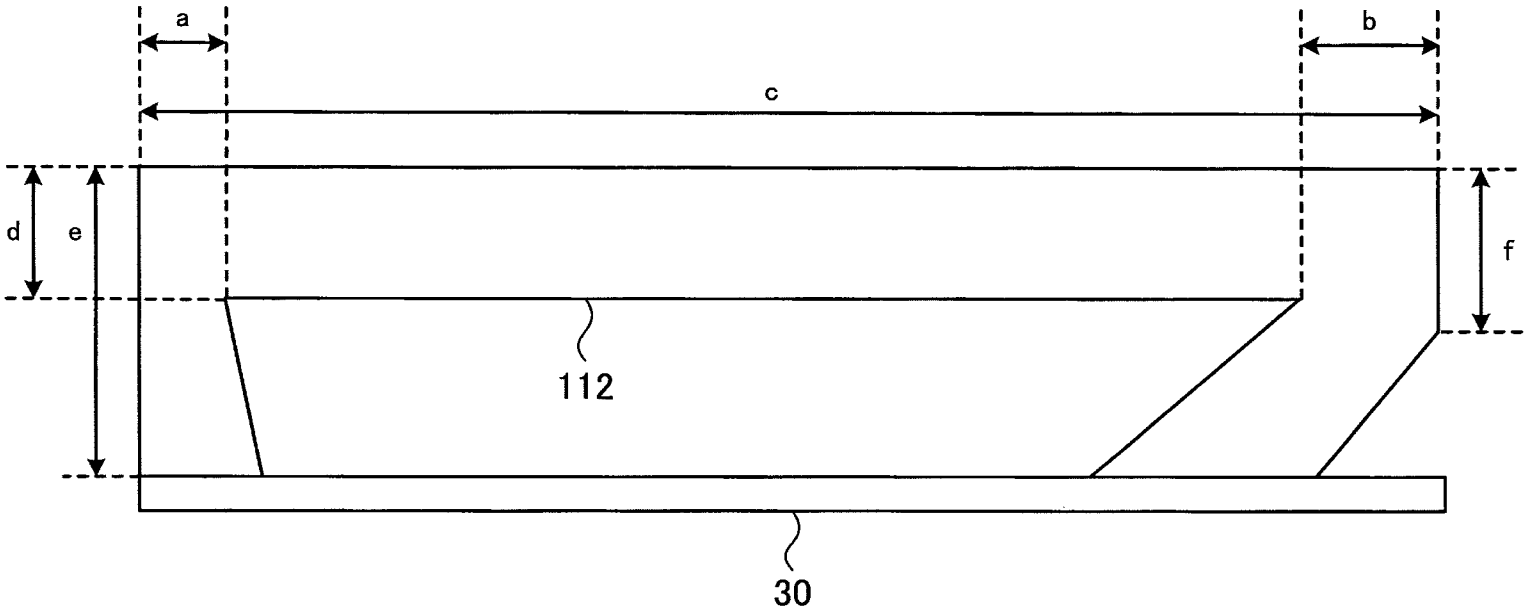
FIG. 21 is a front view of the antenna illustrated in FIG. 16.

FIG. 21 is a front view of the antenna illustrated in FIG. 16. In FIG. 21, the same component elements as those in FIG. 16 are denoted by the same reference numerals, and description thereof is omitted. The values of "a" to "f" illustrated in FIG. 21 are e.g. 3.2 mm, 5.4 mm, 50 mm, 4 mm, 9.6 mm, and 5 mm, respectively.

Figure 22:
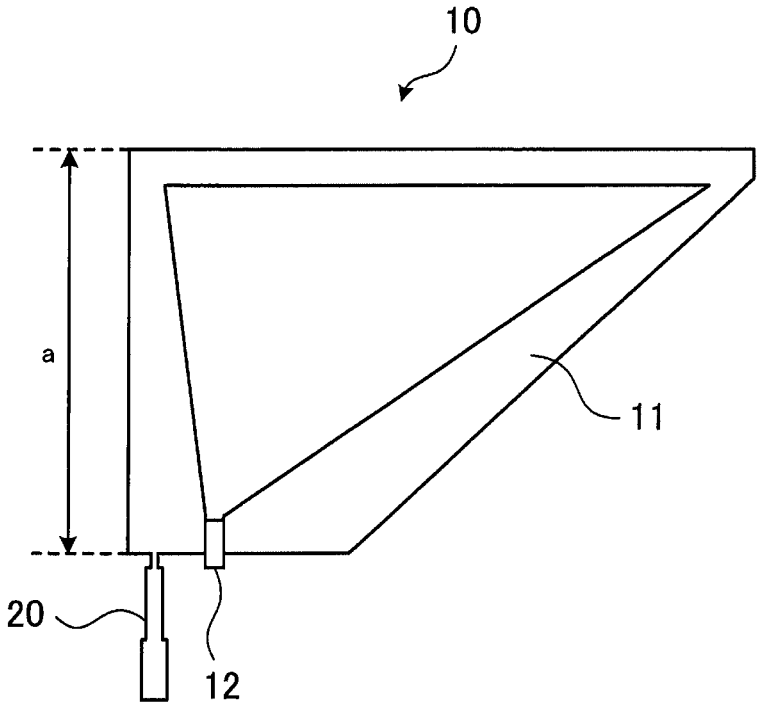
FIG. 22 is a plan view of the antenna described with reference to FIGS. 1 to 3.

FIG. 22 is a plan view of the antenna described with reference to FIGS. 1 to 3. In FIG. 22, the same component elements as those in FIG. 1 are denoted by the same reference numerals, and description thereof is omitted. The value of "a" illustrated in FIG. 22 is e.g. 32.4 mm.

The length of "a" illustrated in FIG. 22 corresponds to the length of "a" illustrated in FIG. 19. Therefore, the antenna 10 including the bent portion 112 illustrated in FIG. 16 can be reduced in length by approximately 40% compared with the antenna 10 without the bent portion illustrated in FIG. 1.

As described above, the antenna 10 can be reduced in size by providing the bent portion 112 in the radiation section 11.

According to the disclosed antenna, it is possible to cover broadband communication without increasing the size of the antenna.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that various changes, substitutions, and alterations could be made hereto without departing from the spirit and scope of the invention.

What is claimed is:

1. An antenna comprising:

a radiator which is in a substantially planar loop form and includes a first connection portion having an end, a second connection portion having an end, and an open portion between the ends of the first and second connection portions; and a switch in the open portion to selectively connect said second connection portion to said first connection portion and a ground.

2. The antenna according to claim 1, wherein said second connection portion is connected to said ground via an inductor.

3. The antenna according to claim 2, wherein said inductor comprises a plurality of inductors, and one of said inductors is selected by said switch.

4. The antenna according to claim 3, wherein the plurality of inductors is two inductors.

5. The antenna according to claim 1, wherein said radiator has a portion which is bent at a predetermined angle in a plane that is different than the plane of the substantially planar loop.

6. The antenna according to claim 5, wherein the predetermined angle is 90° .

7. The antenna according to claim 1, wherein an impedance of the antenna is adjusted according to one of a width and a length of a feeding line which supplies a signal to said radiator, the loop form of said radiator, and a distance between said radiator section and said ground.

8. The antenna according to claim 1, wherein the loop form has a triangular shape.

9. The antenna according to claim 8, wherein the open portion is at a corner of the triangular shape.

10. The antenna according to claim 9, wherein widths of two sides of the triangular shape forming the open portion therebetween are wider than a width of a remaining side of the triangular shape.

11. The antenna according to claim 1, wherein the loop form has a square shape.

12. The antenna according to claim 1, wherein the loop form is a circular shape.

13. The antenna according to claim 1, wherein the switch is a micro-electro mechanical switch.

14. The antenna according to claim 1, wherein the switch is a p-instrinsic-n diode.

* * * * *

UNITED STATES PATENT AND TRADEMARK OFFICE

CERTIFICATE OF CORRECTION

PATENT NO. : 8,665,162 B2
APPLICATION NO. : 13/234607
DATED : March 4, 2014
INVENTOR(S) : Koga It is certified that error appears in the above-identified patent and that said Letters Patent is hereby corrected as shown below:

In the Claims

Column 10, line 56, In Claim 14, delete “instrinsic” and insert -- intrinsic --, therefor.

Signed and Sealed this
Twenty-seventh Day of May, 2014

Michelle K. Lee

Michelle K. Lee
*Deputy Director of the United States Patent and Trademark Office*